United States Patent [19]

Favre

[11] Patent Number: 5,044,177

[45] Date of Patent: Sep. 3, 1991

[54] SETTING SUPPORT FOR A FINE ORNAMENTAL PRECIOUS STONE

[75] Inventor: Henri Favre, Saint Claude, France

[73] Assignee: Diamonts de Joaillerie Henri Favre, Saint-Claude, France

[21] Appl. No.: 434,481

[22] Filed: Nov. 13, 1989

Related U.S. Application Data

[63] Continuation of Ser. No. 249,327, Sep. 26, 1988, abandoned.

[30] Foreign Application Priority Data

Sep. 30, 1987 [FR] France ..... 8713528

[51] Int. Cl.[5] ..... A44C 17/02

[52] U.S. Cl. ..... 63/26; 63/27

[58] Field of Search ..... 63/26, 27, 28, 32; 29/10

[56] References Cited

U.S. PATENT DOCUMENTS

| | | | |
|---|---|---|---|
| 1,319,251 | 10/1919 | Schless | 63/26 |
| 1,368,909 | 2/1921 | Eliasoff . | |
| 1,400,460 | 12/1921 | Rosenthal | 63/26 |
| 1,449,158 | 3/1923 | Wittstein | 63/26 X |

FOREIGN PATENT DOCUMENTS

| | | | |
|---|---|---|---|
| 0221248 | 7/1986 | European Pat. Off. . | |
| 1505450 | 10/1966 | France . | |
| 1543950 | 4/1967 | France . | |
| 2032536 | 2/1969 | France . | |
| 2004228 | 3/1969 | France . | |
| 2036934 | 4/1969 | France . | |
| 2080224 | 2/1970 | France . | |
| 2171039 | 4/1972 | France . | |
| 2186201 | 5/1972 | France . | |
| 2420314 | 3/1978 | France . | |
| 2450078 | 2/1979 | France . | |
| 2491308 | 10/1980 | France . | |
| 2579428 | 4/1985 | France . | |
| 235779 | 6/1925 | United Kingdom | 63/26 |
| 296797 | 5/1927 | United Kingdom . | |
| 2079140 | 7/1980 | United Kingdom . | |

*Primary Examiner*—Laurie K. Cranmer

*Attorney, Agent, or Firm*—Mason, Fenwick & Lawrence

[57] ABSTRACT

The setting support (1) for a stone (21), of the general type produced from metal and comprising an axial bore (16) which is intended for receiving the stone (2) and the front end part (17) of which forms a seat for the collet (10), the necessary plurality of separate setting claws (19) intended to assume position on the crown (9), and at least one facet (20) performing the function of increasing the apparent dimension and brilliance of the stone (2), wherein a mirror facet (20) is arranged along a chord of the setting support (1), in such a way that this mirror facet (20) can extend in a direction at least substantially parallel to one or more adjacent facets (11, 12, 13) of the stone (2), especially of the crown (9), the effect of this arrangement being to ensure the function of the facet (20) of the setting support (1) effectively.

25 Claims, 1 Drawing Sheet

FIG.7A
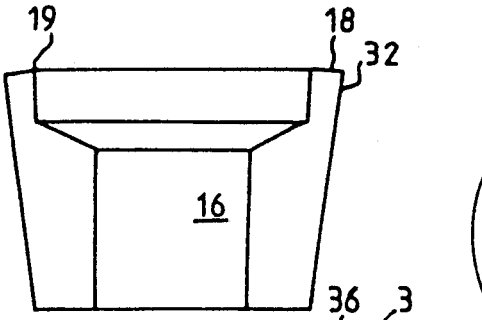
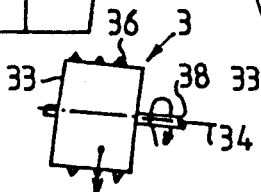
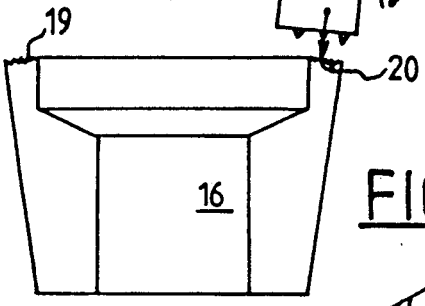
FIG.7B
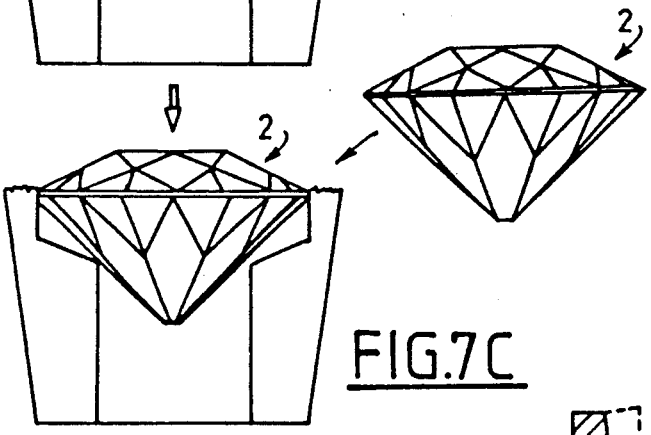
FIG.7C
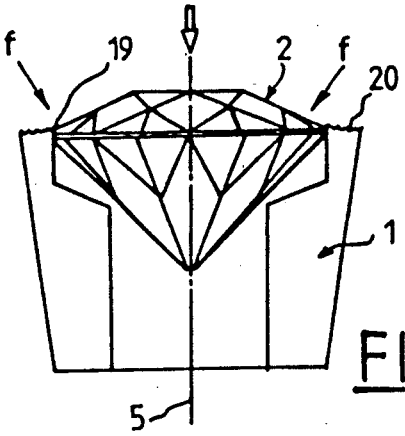
FIG.7D
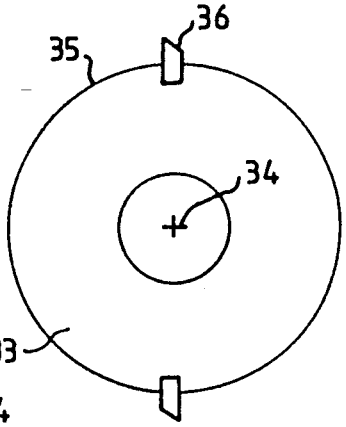
FIG.8
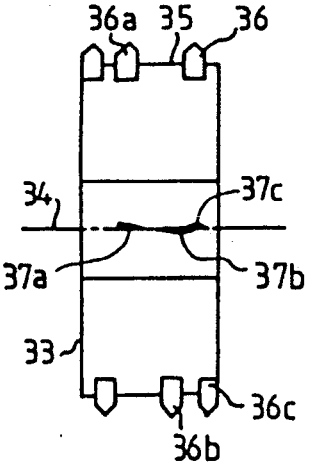
FIG.9
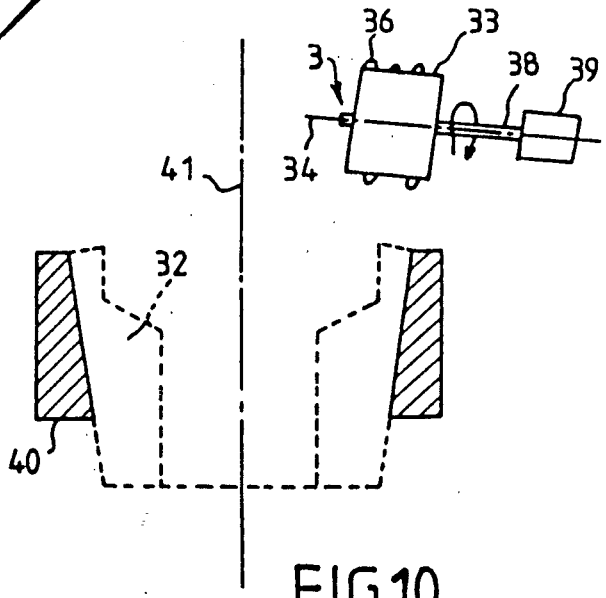
FIG.10

SETTING SUPPORT FOR A FINE ORNAMENTAL PRECIOUS STONE

This application is a continuation of application Ser. No. 249,327, filed Sept. 26, 1988 now abandoned.

FIELD OF THE INVENTION

The invention relates to a setting support for a fine ornamental precious stone, more especially a diamond, a bezel comprising such a stone and such a setting support, a process and a tool for shaping such a support, a shaping appliance incorporating such a tool, and a setting installation incorporating such an applicance.

PRIOR ART

There are already known setting supports for a precious stone, especially a diamond, which more particularly are of small dimensions and made of metal and comprising an axial bore, which is intended for receiving the stone coaxially and the front part of which forms a seat for the lower part or collet of the stone, and, on its upper annular front transverse face, some small setting claws intended to assume position on the crown of the stone, so as to ensure its rigid retention on the support (the documents FR 1,505,450; FR 1,543,950; FR 182,118; FR 2,579,428; FR 2,004,228; FR 2,036,934; FR 2,080,224; FR 2,171,039; FR 2,450,078; FR 2,186,201 and GB 2,079,140).

An attempt is often made to ensure that the setting support should be seen as little as possible, in particular should be the smallest possible, so as not to impair the aesthetic appearance of the stone (the documents FR 2,579,428; FR 2,420,314 and FR 2,491,308).

Attempts have also been made to make use of the setting support in order to enhance the stone. In the document FR 2,579,428, the setting support is cut to the same shape as the diamond. The document FR 2,186,201 claims to give the impression of a magnification of the stone (or of an increase in its brilliance) and it is asserted that the light rays entering the stone are directed onto metal "mirror-finish" facets of the lower part of the setting support which are located on that side of the collet reflecting these rays towards the immediate exterior of the stone (or towards the center respectively). According to this document, light enters as a result of the perforation of the setting support and its functional use. However, this document, of which there is no known actual use, seems to be purely an imaginary notion; there is no mention of the method of obtaining a mirror finish; the size of the diamonds has changed and now total reflection is obtained (see "Les Pierres Précieuses" ("Precious Stones"), Tardy and Dina Level, page 210), thus preventing the possibility of the phenomenon described in this document; in practice, the perforation is often masked by the skin, and it is illusory to cause light to enter by this means; it is neither possible nor customary to examine a stone perpendicularly relative to the table, the light rays likewise being perpendicular; the effect of any possible reflection of light on a wall of the setting support which passed through the stone would be to disperse the color of the setting support in the stone, and the result of this would be to devalue the stone by impairing its color.

Attempts have also sometimes been made to give the setting support a certain aesthetic appearance; either the support has a suitable geometrical shape forming an "embellisher" or the setting is beautified by "lifting the grain" by means of gouging cuts made by the setter. However, that does not aim to increase the apparent dimension and brilliance of the stone.

The document FR 1,543,950 provides a grinding of the setting support in order to mark out designs with sharp edges which make it easier for the light rays to be reflected on the stone and which enhance the luster of the latter. These designs extend radially in relation to the axis of the stone. There is also provision for the same function to be performed by grooves, likewise radial, obtained as a result of the formation of the setting claws. However, these grooves are insignificant, and their effect is limited and is not to increase the apparent dimension and brilliance of the stone.

The document GB 2,079,140 describes a setting support for stones, especially diamonds, of small dimensions (a diameter of the order of 3 mm), which, on its annular front transverse face, has facets grouped in pairs, each recessed, and likewise arranged radially around the stone. The first function of these pairs of facets would be to provide the quantity of metal necessary for forming the mounts, and their second function would be to give the appearance of a stone larger or more brilliant than it actually is. Such a support is produced by punching, in such a way that the facets and the mounts are produced simultaneously as a result of a single operation ensuring the requisite displacement of the material. However, the technique described in this document is open to dispute, besides the fact that it does not seem to have been put into practice on an industrial scale; the pressures and forces exerted during the punching or swaging are necessarily high, and without doubt their effect is to break the stone, including the diamond (in fact, it is known that if the diamond is hard it is also fragile and sensitive to cleavage and breakage and that, consequently, setting must be carried out with great care - see "Les Pierres Précieuses" ("Precious Stones"), Tardy and Dina Level, pages 195 and 196; "Guide des pierres précieuses, pierres fines et pierres ornementales" (Guide to precious stones, fine stones and ornamental stones"), Walter Schumann, Ed Delachaux et Niestlé, page 70; "Pierres Précieuses et Pierres Fines" ("Precious Stones and Fine Stones"), Jaroslev Bauer and Vladimir Bouska, Bordas Publ., page 31); the angles of the facets formed on the setting support are not sufficiently sharp to simulate a luster resembling that of the stone; the mounts of the setting support cover the entire periphery of the crown over a substantial radial extent and thus cover a considerable proportion of the crown, thereby abstracting from the stone a considerable proportion of its effective diameter (of the order of 20%), this technique coming close to the well-known technique of the closed mount; the mirror effect on the facets of the setting support is impossible to obtain by punching or swaging, since the metal of the support "sticks" to the punch; production at a low cost price and in a large quantity is impossible to achieve, since the punch has to be cleaned or changed regularly; the angles of inclination of the facets and their width do not appear to be determining factors.

Appliances for setting a precious stone are also known (the documents FR 2,032,536; FR 2,545,241 and EP 0,221,248).

The checkered pattern intended essentially for solid pieces, such as plates or lighters, but not for stone supports is known. Moreover, the known checkered patterns have only a purely decorative and non-functional purpose. They are not associated with a precious stone, and they do not have the qualities of mirror finish, sharp edges, angles of inclination, dimensions, etc. suitable for performing such a function.

The document U.S. Pat. No. 1,449,158 describes a bezel which is such that the stone and the support are so intermixed that the stone and the support appear to be a single stone.

The document U.S. Pat. No. 1,368,909 describes a stone support having a supposedly improved visual appearance.

The document GB 296,797 describes a stone support having a closed conical stone seat.

SUMMARY OF THE INVENTION

The invention aims to overcome the disadvantages or limitations of the state of the art and, more particularly, to provide a setting support which effectively performs the function of increasing the apparent dimension (or brilliance) of the stone, without risking impairing the stone (in terms of its wholeness, its effective diameter and its color), by means of a process and devices which are satisfactory in economic and industrial terms.

To this end, the invention first provides a setting support for a stone, especially a fine, ornamental, precious stone, especially a diamond, more particularly a stone of small dimensions, especially of a diameter of the order of a millimeter or a few millimeters, of the general type produced from metal and comprising, in the first place, an axial bore which is intended for receiving the stone coaxially and the front end part of which forms a seat for the collet of the stone, and in the second place, on its annular front transverse face, the necessary plurality of separate setting claws intended to assume position on the crown of the stone, thus ensuring its rigid retention on the support, and in the third place, on its annular front transverse face, at least one plane facet inclined relative to the general transverse plane of this front transverse face and performing the function of increasing the apparent dimension and brilliance of the stone, defined in that a mirror facet of the support is arranged along a chord of the support, in such a way that this mirror facet of the support can extend in a direction D at least substantially parallel to and in alignment with one or more adjacent facets of the stone, especially of the crown, the effect of this arrangement being effectively to ensure the function of extending the facet of the support.

According to other characteristics, the support has a plurality of mirror facets; this mirror facet or these mirror facets are obtained by milling cutting, more especially diamond-cutting, and are arranged in one pair or usually in a plurality of pairs of mirror facets having a cross-section in the general form of a V or pseudo V, upright or overturned, with or without a web edge, and of an angle between 120° and 150°, more especially between 135° and 145°.

The invention subsequently provides a bezel which, in the meaning used here, is the association of a support and of a stone.

The invention also provides a process for the shaping of such a support, involving the shaping of the setting claws and the shaping of the facets in two separate operations, in particular the facets after the claws.

The invention also provides a process for setting a stone, involving such a process for shaping the support.

The invention also provides a tool for shaping the facets of such a support, which comprises a stage which is designed to be driven in rotation about its axis and to the periphery of which is fastened rigidly at least one shaping diamond projecting radially outwards and suitably cut and performing the function of shaping at least one mirror facet of the support.

The invention also provides an appliance for shaping the facets of such a support, which comprises at least one such shaping tool, a drive spindle to which such a tool can be connected rigidly and removably, means for driving the spindle in rotation, and at least one setting-support holder, to which the support can be connected rigidly and removably.

The invention finally provides a setting installation comprising at least one setting appliance and at least one such appliance for shaping the facets of the support.

The invention is based on the utilization of the optical and physiological properties and capacities of the eye, in particular retentivity, that is to say image persistence, combined with the close point and the far point.

The effect of the invention is to increase the apparent dimension (if appropriate, the brilliance) of the stone, when the latter is examined at the normal angles of incidence of the conventional examination of the stone, especially of the order of 30° (relative to the plane of the table), the latter being mounted in a setting support with or without exposure. For example, it is thus possible to "enlarge" the diameter of the stone by approximately 2 to 7 tenths of a millimeter, depending on the size of the stone.

Furthermore, this result can be obtained by means of a process and devices which can be used on an industrial scale.

As emerges from the description, this effect arises as a result of the transverse width of the setting support between its inner and outer free edges, the angles of the mirror facets and their offset (or eccentricity) in relation to the support (or its axis).

BRIEF DESCRIPTION OF THE DRAWINGS

The other characteristics and advantages of the invention will emerge from the following description, with reference to the accompanying drawings which are solely explanatory and purely diagrammatic (and not capable of limiting the scope of the invention) and in which:

FIGS. 7A, 7B, 7C and 7D are four diagrammatic views in axial section illustrating the processes according to the invention.

FIG. 8 is an elevation view of a shaping tool according to the invention on a larger scale.

FIG. 9 is a side view of the shaping tool of FIG. 8.

FIG. 10 is a diagrammatic elevation view of a shaping appliance according to the invention.

DESCRIPTION OF THE PREFERRED EMBODIMENT

Figure 1:
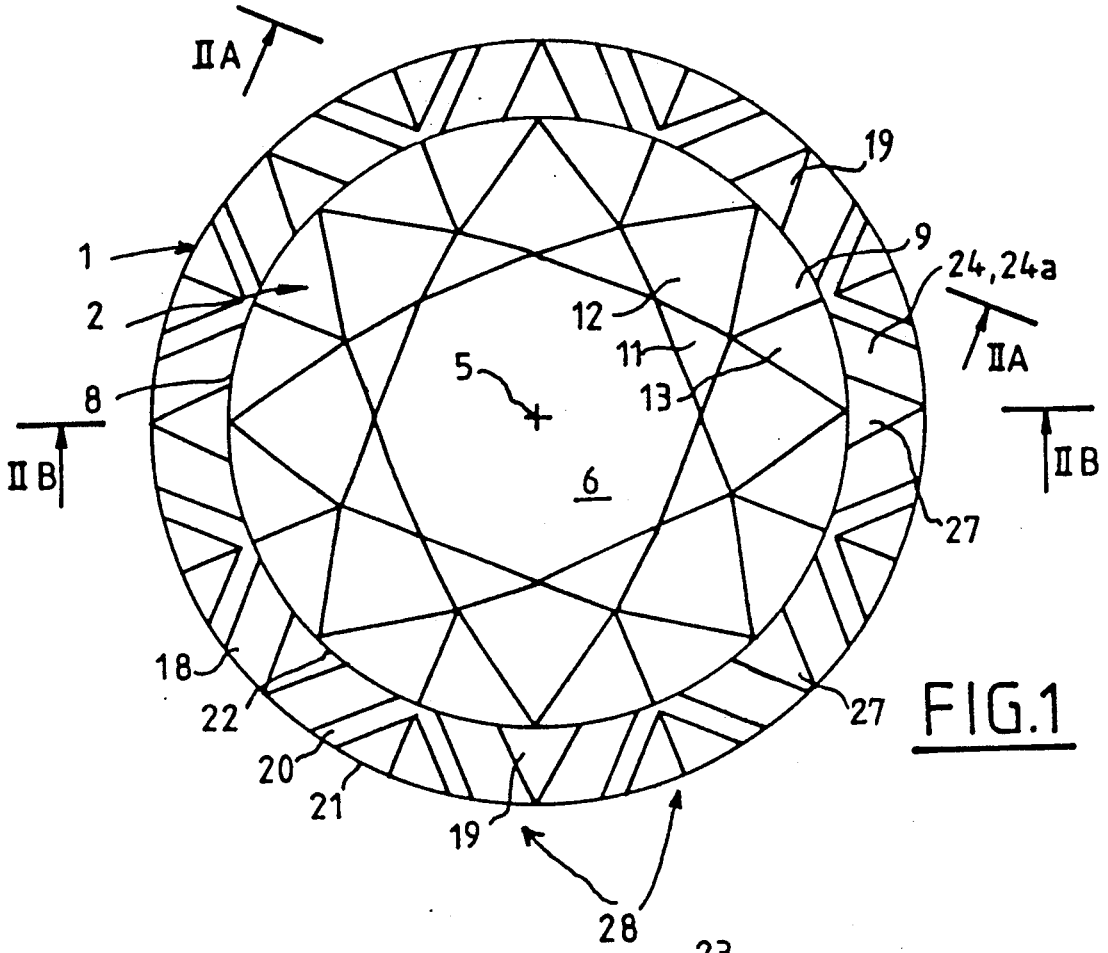
FIG. 1 is a top view, on a large scale, of a stone, such as a diamond, cut as a brilliant, associated with a setting support according to the invention.
Figure 2A:
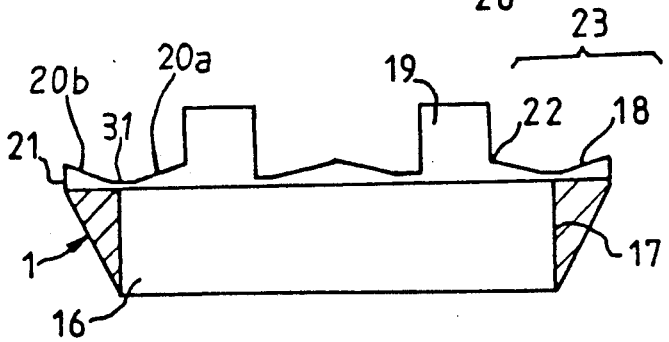
FIGS. 2A and 2B are two diagrammatic sectional views parallel to the axis of the stone/support assembly along the lines IIA—IIA and IIB—IIB respectively of FIG. 1.
Figure 2B:
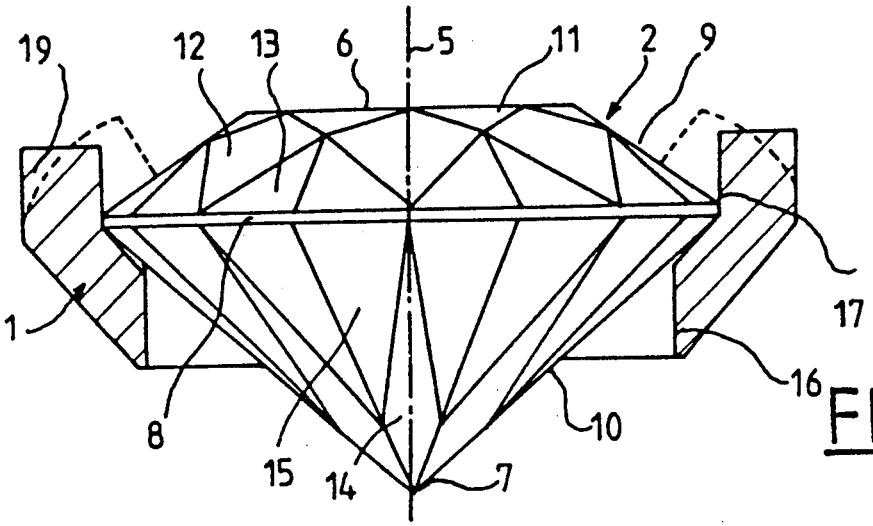
Figure 3:
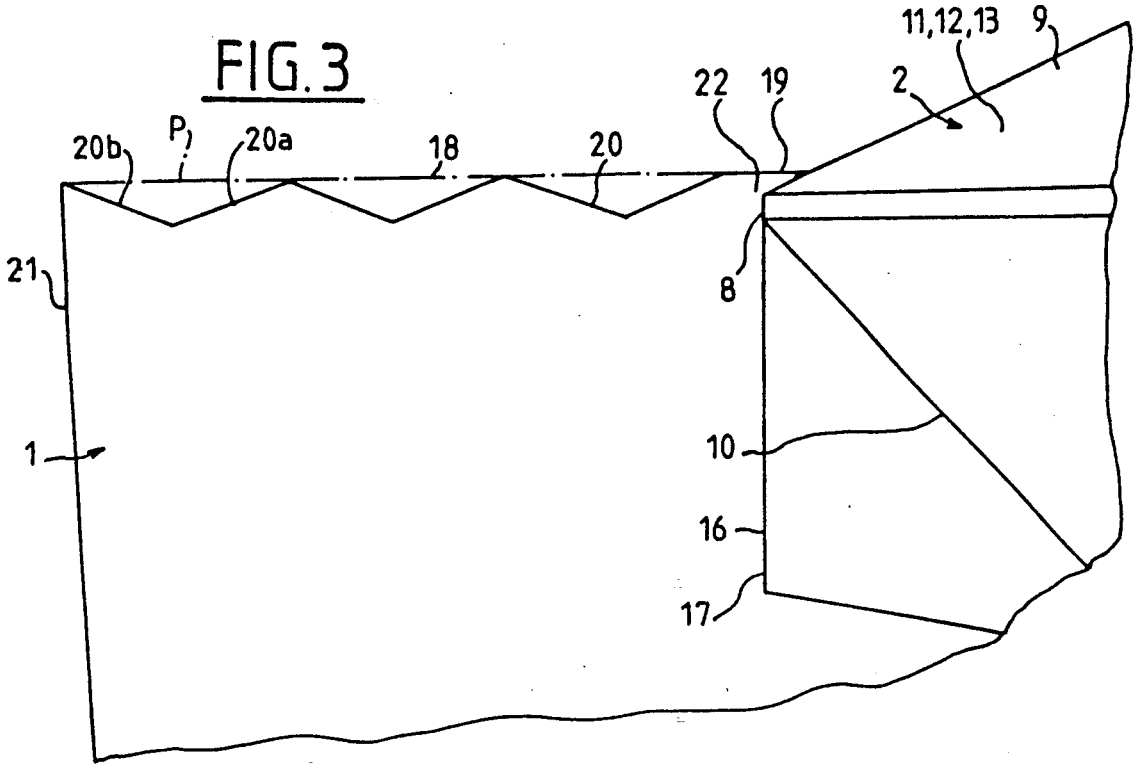
FIG. 3 is a partial view with axial section on a larger scale.

The invention relates to a setting support 1 for a stone 2, especially a fine, ornamental, precious stone; a bezel 1, 2 comprising the stone 2 and the support 1; a process and a tool 3 for shaping the support 1 (FIGS. 8 and 9), more specifically its facets; an appliance 4 for shaping the support 1, especially the facets, incorporating the shaping tool 3 (FIG. 10), and a setting installation incorporating the appliance 4.

The invention applies more particularly, but not exclusively, to diamonds and, more especially, to stones 2 of small dimensions, particularly of a diameter of the order of a millimeter or a few millimeters.

For example, the stone 2, especially the diamond, is cut as a brilliant. It is to this that the invention refers, but it can also apply to other cuts and/or other stones.

The stone 2 comprises an axis 5, a table 6 (upper transverse and perpendicular to the axis 5), if appropriate a lower collar 7, a girth or girdle 8 (transverse, intermediate and in a plane perpendicular to the axis 5), a crown 9 (between the table 6 and the girdle 8), and a canopy or collet 10 (between the collar 7 and the girdle 8), the crown 9 and the collet 10 being cut so as to have facets (such as the stars 11, the bevels 12 and the corners 13 for the crown 9 and the facets 14 and corners 15 for the collet 10). The terminology used here is that originating from the literature referred to in the introduction. Other expressions can be used. The terminology and expressions adopted cannot limit the scope of the invention.

The support 1 is of the general type produced from metal, comprising in the first place a bore 16 of axis 5 which is intended for receiving the stone 2 coaxially, and the front end part 17 of which forms a seat for the collet 10; in the second place, on an annular front transverse face 18, the necessary plurality of setting claws 19 separate from one another and intended to assume position on the crown 9 from the girdle 8, thus ensuring the rigid retention of the stone 2 on the support 1, and in the third place, on its front transverse face 18, at least one plane facet 20 inclined relative to the plane P of this front transverse face 18 and performing the function of increasing the apparent dimension (and, if appropriate, the brilliance) of the stone 2.

The axial extent of the support 1 along the axis 5, its outside diameter and the form of the bore 16 (such as, for example, the presence of a perforation) can have alternative versions. The same is true of the characteristics of the front transverse face 18; the form and dimensions of the outer free edge 21; the form and dimensions of the inner free edge 22; the distance between the edges 21 and 22 or "skin" (or the transverse width of the support 1 between its free edges), which can be between one tenth of a millimeter and approximately four tenths of a millimeter, more especially equal to or in the neighbourhood of three tenths of a millimeter, and the number of claws 19. For example, the edges 21 and 22 can be circular or pseudo-circular, the face 18 can have a general form of a radially narrow ring, plane and perpendicular to the axis 5, and the claws 19 can be of a number equal to the number of stars 11 or bevels 12 (for example, eight claws), but, where a smaller stone is concerned, can be of a number less than the number of stars or bevels.

The expression "bezel" 1,2 in the description conventionally denotes the assembly consisting of the support 1 and of the stone 2 connected rigidly to one another.

According to one characteristic of the bezel 1, 2, the claws 19 are separated, apart from one another and of small dimensions, and the edge 22 is adjacent to or set slightly outwards from the girdle 8, so that the entire or virtually the entire table 6 and crown 9 is visible.

The transverse general plane P of the face 18 refers to a mid-plane passing through the line of the face 18 and perpendicular to the axis 5 (the drawing plane) and tangential to the face 18.

A mirror facet 20 of the support 1 is arranged along a chord of the support 1, in such a way that this mirror facet 20 can extend in a direction D at least substantially parallel to colinear or substantially colinear edges of one or more adjacent facets (11, 12, 13) of the stone 2, especially facets 11 and 12 adjacent the crown 9, the effect of this arrangement being to ensure the function of the facet 20 effectively.

A mirror facet 20 does not interfere with or impair any one of the claws 19, being independent of these. A mirror facet 20 is set transversely apart from one or more claws 19. Conversely, a claw 19 is set apart from one or more mirror facets 20 transversely relative to these.

Figure 5:
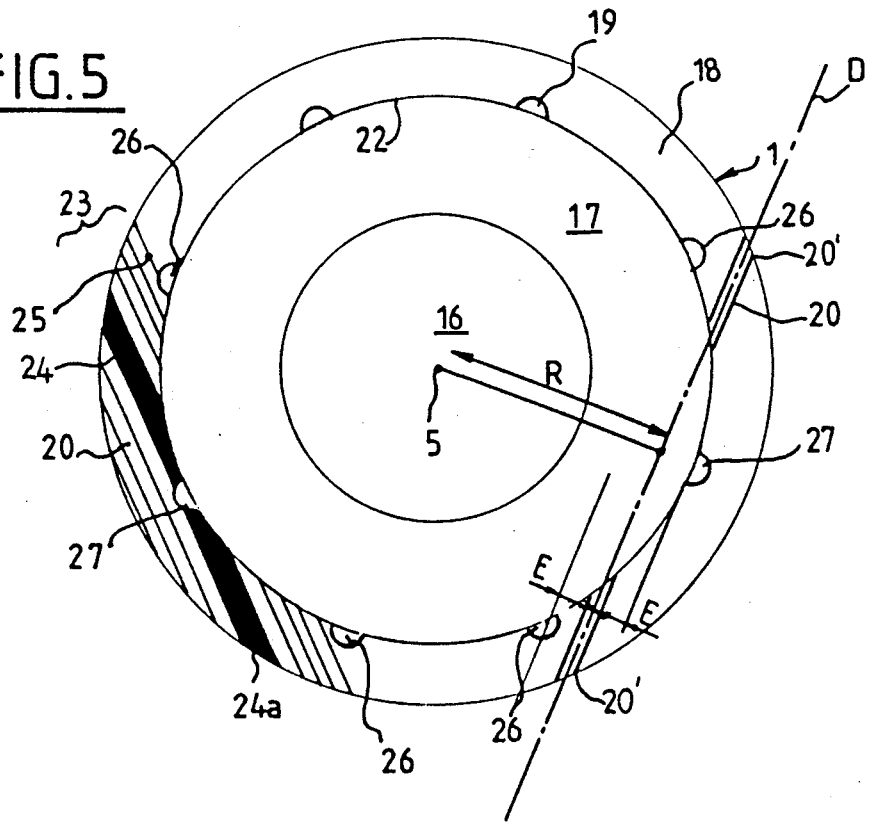
FIGS. 5 and 6 are two purely diagrammatic top views of a setting support illustrating other characteristics or alternative versions of the invention.

In FIG. 5, a single mirror facet 20 has been shown purely diagrammatically for easier understanding.

The mirror facet 20 forms a chord, that is to say it extends between two points or zones 20' of the edge 21 which are not diametral, that is to say the facet 20 is not radial or diametral or that the facet 20 is offset or eccentric relative to a diameter of the support 1. As regards the mirror facet 20 of FIG. 5, this is divided into two portions, being interrupted by the edge 22. The invention also relates to a mirror facet 20 in a single portion, provided that the distance between this mirror facet 20 and the axis 5 is greater than the radius of the edge 22.

D, the direction of a mirror facet 20, denotes the straight line orthogonal to the axis 5 located in the mirror facet 20 under consideration; T, the transverse plane of the mirror facet 20, shown in FIGS. 4A–4D, denotes the plane passing through the axis 5 and perpendicular to the direction D or any plane parallel to this. The intersection of the mirror facet 20 and the transverse plane T defines a cross-section of the mirror facet (its profile). The axial distance R of the mirror facet 20 denotes the radius segment perpendicular to the axis 5 and to the straight line D and located between this axis 5 and this straight line D. This axial distance is non-zero and even substantial, the mirror facet 20 being a chord of the front transverse face 18.

The claws 19 are not located in the mirror facet 20, and more specifically there is a certain transverse distance E (parallel to the axial distance R) between the claws 19 and the mirror facet 20 (FIG. 5).

Figure 4A:
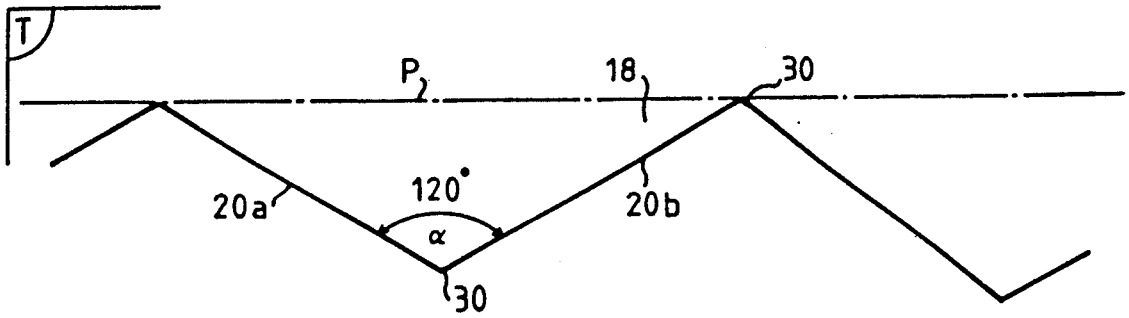
FIGS. 4A, 4B, 4C and 4D are four diagrammatic cross-sectional views of four possible, but non-limiting embodiments of mirror facets of the setting support when they form pairs of facets.

According to other characteristics, shown in FIGS. 4A and 4 a mirror facet 20 is inclined relative to the plane P at an angle of between approximately 15° and approximately 30°, more especially between approximately 17° and approximately 23°. Such a mirror facet 20 also faces towards the inside or towards the outside of the support 1, that is to say towards or opposite to the axis 5. The various adjacent mirror facets **20*a* and 20*b* face alternately towards and opposite to the axis 5**.

Preferably and generally, the support 1 has a plurality of mirror facets 20, a single mirror facet 20 being insufficient alone to perform to any appreciable extent the function of increasing the apparent dimension (or the brilliance) of the stone 2 at different viewing angles of the stone 2 and different angles of incidence of the light. There are several, especially a large number of mirror facets 20 (for example, one or more tens or one or more hundreds).

There is a first plurality of mirror facets 20 extending at least substantially parallel to one another and forming a first group 23 of mirror facets 20. Such a first group 23 is represented in FIG. 5 separately by several grouped mirror facets 20. Three first group 23 are also shown in FIG. 6.

Figure 4B:
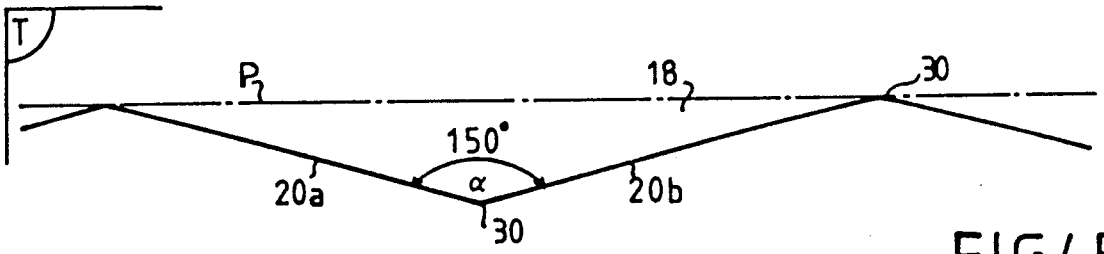
Figure 4C:
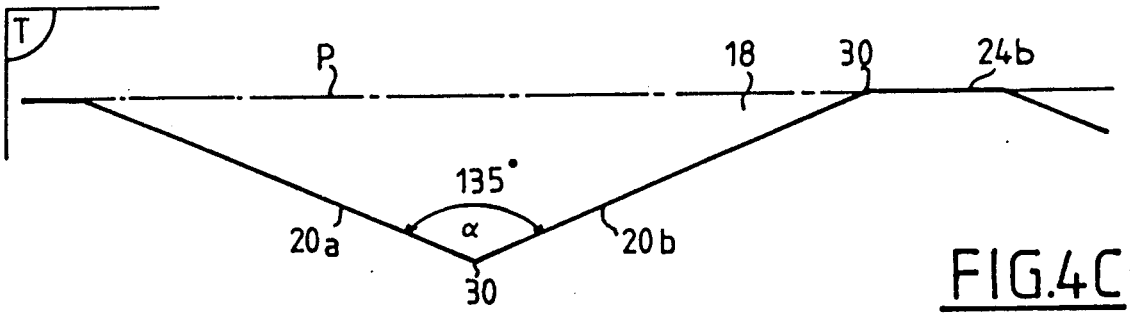

Preferably, the mirror facets 20 of a first group 23 are completely or only partially at least substantially adjacent or near to one another. In particular, two adjacent mirror facets 20*a* and 20*b* are contiguous to one another (FIGS. 4A and 4B). Or two adjacent mirror facets 20*a* and 20*b* are separated from one another by means of a more or less wide, especially transversely narrow, separation strip 24*b* (FIG. 4C).

Preferably, the mirror facets 20 of a first group 23 extend from or from the vicinity of a boundary chord 25, a boundary chord being defined as a chord of face 18 connecting two separate reference claws 26 or the regions of these and towards the edge 21. According to a first alternative version, the two reference claws 26 are defined as two claws 19 which are adjacent (the left-hand part of FIG. 6). According to a second alternative version, the two reference claws 26 are defined as two claws 19 which are separated from one another by means of at least one intermediate claw 27 (the right-hand part of FIG. 6, FIG. 1 and FIG. 5). This second alternative version can have several sub-versions, depending on the number of intermediate claws 27 (combined with a total number of claws 19). In FIG. 1, there are two intermediate claws 27, and in FIG. 5 there is a single claw 27, these examples not being limiting.

Figure 6:
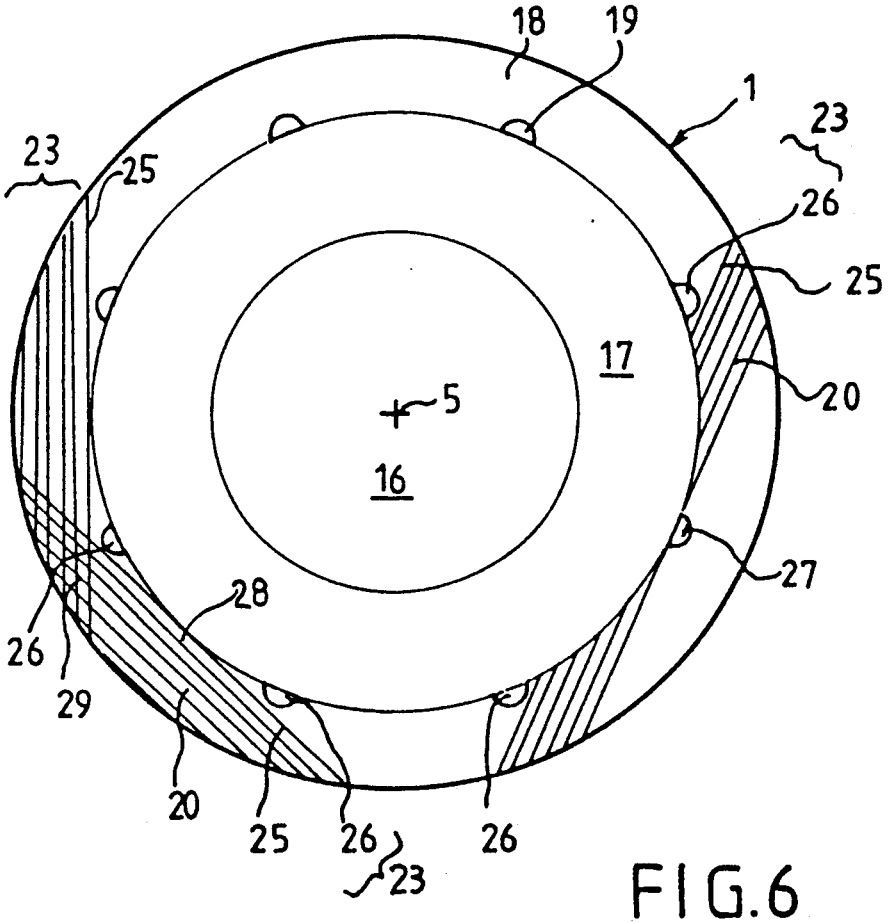

According to FIGS. 5 and 6, a boundary chord 25 is located in the immediate vicinity of and towards the outside of each pair of reference claws 26. This arrangement is such that the aperture angle of the boundary chord can reach, for example, 100°, this value being merely indicative, with regard to a brilliant cut with eight claws 19, the claws of each pair of reference claws 26 being separated by means of a single intermediate claw 27.

Preferably, the mirror facets 20 extend longitudinally and/or transversely (relative to their direction) up to or into the vicinity of the edge 21 (the left-hand part of FIG. 5).

Alternatively, the mirror facets 20 extend in front of and/or behind at least one intermediate claw 27 in relation to the axis 5. In particular, they form between them a reserved or preserved strip 24*a*, as shown in the left-hand part of FIG. 5, in which this intermediate claw 27 is located. Each strip 24*a* is a particular example of a strip 24 separating two adjacent mirror facets 20.

Preferably, as well as having a plurality of first groups 23 of mirror facets 20, the support 1 also has a plurality of second groups 28 of mirror facets 20. The facets 20 of each second groups 28 are arranged angularly relative to one another in relation to the axis 5.

In general, the mirror facets 20 of a second group 28 are arranged around the axis 5, at least substantially uniformly. Thus, the second groupd 28 are substantially concentric with each other.

In particular, this relative arrangement is the same as that of the claws 19. There are therefore as many second groups 28 as claws 19.

One single mirror facet 20 belongs to a first group 23 and to a second group 28, the distribution in the form of first and second groups merely being intended to make it easier to understand the invention. Moreover, the first and second groups 23, 28 can intersect (FIG. 6) in zones 29 which, in this particular case, are located behind the claws 19. Depending on the arrangements of the claws 19 and/or of mirror facets 20, the intersection zones 29 are of small extent, zero or almost zero or, on the contrary, involve the whole or virturally the whole of the mirror facets 20 or of the area of the face 18 or of the region of this area where these mirror facets 20 are located. Or the zones 29 are of a size between these extremes. The zones 29 are either concentrated or distributed as a function of these arrangements. In a particular instance, the mirror facets 20 of the first and second groups 23, 28 intersect two by two, especially in as many series of aligned faces as the set stone 2 possesses. In another particular instance, the mirror facets 20 intersect over a substantial part of their extent.

For example, all or only some of the mirror facets 20 of a first specific groups 23 intersect all or only some of the mirror facets 20 of only the first two adjacent groups 23. The zones 29 occupy, for example, more than approximately 20% of the total area where the mirror facets 20 are located.

In the embodiment of FIG. 1, the mirror facets 20 occupy a substantial part, especially the virtual entirety or the entirety of the face 18. The function of the mirror facets 20 is then performed by the entirety or the virtual entirety of the area of the face 18.

Some mirror facets 20 extend between at least substantially the regions neighbouring two separate reference claws 26, and/or some mirror facets 20 extend virtually tangentially or are merged with the edge 21 of support 1. In the first case, the mirror facets 20 are near the boundary chord 25. In the second case, they are of very short length (in direction D).

At least some mirror facets 20 are longitudinally extensive, their length being clearly greater than their transverse width.

The mirror facets 20 have a "mirror-finish" surface state and sharp edges 30. The surface state arises particularly as a result of the process of shaping by diamond-cutting which is used, as described hereinafter. The edge 30 of a mirror facet 20 referes to the edge separating this mirror facet 20 from the face 18 or from the adjacent mirror facet 20 of a first group 23 or from another mirror facet 20 of a second groups 28 in a zone 29.

A mirror facet 20 is a relief projecting or preferably recessed in relation to the face 18.

Associated with a first mirror facet 20*a* is a second mirror facet 20*b* as shown in FIGS. 4A–4D, and together they define a pair of facets 20*a*, 20*b* of similar general characteristics and of oppositely directed angles of inclination relative to the face 18, thereby forming in relation to the transverse general plane P of the latter a relief which, in cross-section, has the general form of a V or pseudo V, upright or overturned. These two mirror facets 20*a*, 20*b* are produced in one piece simultaneously. All the characteristics described for a mirror facet 20 apply to each of the mirror facets 20*a*, 20*b*.

Preferably, the angles of inclination of the two mirror facets 20*a*, 20*b* of a same pair of mirror facets of the setting support 1 are at least substantially equal in value, the V of the cross-section being at least substantially symmetrical relative to a mid-plane of the pair of mirror facets which is especially parallel or substantially parallel to the axis 5. This alternative embodiment is shown in FIGS. 4A to 4D. If necessary, the V of the pair of mirror facets 20*a*, 20*b* can be asymmetric.

Figure 4D:
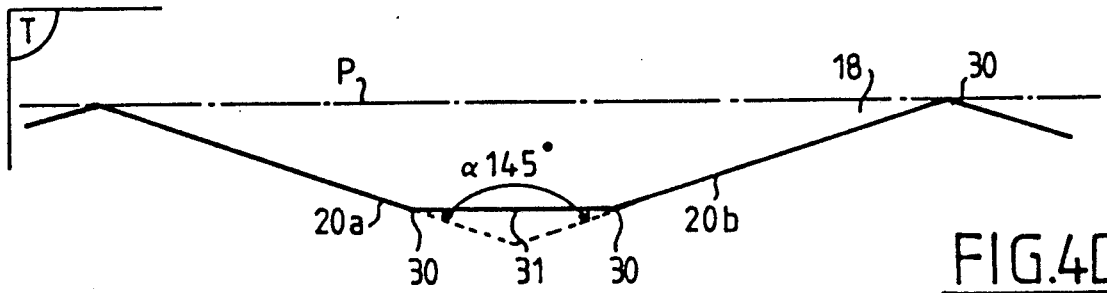

Alternatively, the two mirror facets 20*a*, 20*b* of a same pair of mirror facets are joined to one another, opposite the face 18, by means of a web edge 31, for example located in a plane at least substantially parallel to the transverse general plane P of this face 18 (FIG. 4D). In this alternative version, the web edge 31 is of limited transverse width to ensure the substantial presence of the mirror facets 20*a*, 20*b*.

As emerges from the values already given for the angles of inclination, the two mirror facets 20*a*, 20*b* of a same pair of mirror facets of the setting support 1 form with one another an angle $\alpha$ of between 120° and 150°, more especially between 135° and 145°. The effect of such a structure is to reflect the light rays at all the angles at which the stone 2 is viewed.

This angle is respectively equal to 120°, 150°, 135° and 145° (with a web edge 31) in FIGS. 4A, 4B, 4C and 4D.

Preferably, and in view of the anticipated shaping process (diamond-cutting), a pair of facets 20*a*, 20*b* forms a recess groove in the face 18.

Preferably, a cross-section of a pair of mirror facets 20*a*, 20*b* is at least substantially constant in terms of form and/or dimensions over the entire length of this pair of mirror facets 20*a*, 20*b*. However, the anticipated shaping process allows a variable section.

In one possible embodiment, the transverse width of the web edge 31 is of a value promoting the reflection of the light rays, especially of the order of at most one third of the transverse width of a mirror facet 20. The web edge 31, like the mirror facets 20, has a "mirror-finish" surface state and sharp angles 30, and/or is obtained by milling cutting, especially diamond-cutting.

Two pairs of mirror facets 20*a*, 20*b* of a first group 23 which are mutually adjacent are contiguous to one another or separated from one another by means of a connecting strip 24*b*. The first instance is illustrated in FIGS. 4A, 4B and 4D and the second in FIG. 4C. The connecting strip 24*b* is a particular instance of the strip 24 already described.

Preferably, the various mirror facets 20 and/or pairs of mirror facets 20*a*, 20*b* have inherent characteristics, such as particularly inclination and transverse width, which are identical or similar or with size ratios, as already defined.

A mirror facet 20 extends in a direction D at least substantially parallel to the colinear or substantially colinear edges of one or more adjacent or neighbouring facets 11 12, 13 of the stone 2, especially facets 11 and 12 adjacent its crown 9.

This arrangement can be seen in FIG. 1. Its effect is that, in visual terms, the mirror facets 20 seem to "extend" the facets 11, 12, 13 of the crown 9, thus increasing the effectiveness of the desired function.

When there is a plurality of mirror facets 20, all or substantially all the mirror facets 20 extend in a plurality of directions D at least substantially parallel to the colinear or substantially colinear edges of several separate facets 11, 12, 13 of the crown 9. In particular, the second plurality 28 of mirror facets 20 extends in directions D at least substantially parallel to the colinear or substantially colinear edges of all or a substantial proportion of the facets 11, 12, 13 of the crown 9.

A process for shaping a support 1 involves the shaping of the support 1 and the shaping of the facets 20. The shaping of the claws 19 and the shaping of the facets 20 are carried out in two separate operations.

In particular, first the support 1, especially the claws 19, and subsequently the mirror facets 20 are shaped. The shaping of the facets 20 is carried out by milling cutting, in particular by means of a diamond tool 3, thus making it possible to obtain the required accuracy (shape, dimension, position), a mirror finish and sharp angles 30.

A process for setting a stone 2 by means of a support 1 involves a process for shaping the support 1, as described, and a process for setting the stone 2 in the support 1. More especially, the process of shaping the support 1 and the process for the actual setting of the stone 2 are carried out in two separate operations, first the shaping of the support 1 and subsequently the actual setting of the stone 2.

Starting from a support 32 having its claws 19, but without mirror facets 20 (FIG. 7A), the mirror facets 20 are shaped by means of the tool 3 (FIG. 7B), and after the stone 2 has subsequently been put in place (FIG. 7C) the claws 19 are turned down (FIG. 7D), the arrows f illustrating this setting diagrammatically.

A shaping tool 3 for carrying out the shaping process comprises (FIGS. 8 and 9) a stage 33 which is designed to be driven in rotation about its axis 34 and to the periphery 35 of which is fastened rigidly at least one shaping diamond 36 or the equivalent projecting radially outwards and suitably cut and performing the function of shaping at least one mirror facet 20.

The function of one and the same shaping diamond 36, as a result of its cut, is to shape two mirror facets, such as 20*a*, 20*b*, simultaneously.

A shaping diamond 36 or the equivalent is preferably fastened rigidly to the stage 33, particularly by means of adhesive bonding and gripping. An adhesive, such as an adhesive of the epoxy type, can be used.

Preferably, the tool 3 comprises several shaping diamonds 36 arranged in line with several separate points 37 of the axis 34 of the stage 33. The notion of "points 37" is approximate, and zones are just as appropriate, the latter in practice being reduced areas.

Depending on the requirement laid down by the configuration of the mirror facets 20 on the setting support 1, the shaping tool 3 can comprise (FIG. 9) at least one pair of shaping diamonds 36*a*, 36*b* arranged in line with two separate adjacent points 37*a*, 37*b* located on the axis 34 of the stage 33 and set apart from one another, so as to produce a pair or pairs of mirror facets 20*a*, 20*b* set apart from one another especially by means of a reserved strip 24; or at least two shaping diamonds 36*b*, 36*c* arranged in line with two separate adjacent points 37*b*, 37*c* located on the axis 34 of the stage 33 and contiguous to one another, so as to produce a pair pairs of mirror facets 20*a*, 20*b* contiguous to one another.

If appropriate, the shaping diamonds 36 are distributed at least substantially uniformly on the periphery 35. In particular, two shaping diamonds 36 arranged in line with two separate adjacent points 37 on the axis 34 of the stage 33 are spaced from one another in a polar manner on the periphery 35 of the stage 33. In a particular instance of this polar spacing, the two shaping diamonds 36 under consideration are diametrically opposed.

Alternatively (not shown), the tool 3 comprises several shaping diamonds 36 identical or otherwise which are arranged in line with the same point 37 on the axis 34 of the stage 33.

To form a first subgroup of a plurality of mirror facets 20, the tool 3 comprises a same plurality of shaping diamonds 36 (or, more exactly, axial positions, such as 37). Alternatively, where the shaping diamonds 36 are concerned, the tool 3 comprises only a proportion of the said plurality of mirror facets 20 (including a single shaping diamond 36 or a single position 37), and there are means for moving the tool 3 so formed axially along its axis 34 in order to ensure the shaping of all the mirror facets 20.

An appliance 4 for shaping a support 1 which comprises (FIG. 10) at least one tool 3, as described; a drive spindle 38, to which such a tool 3 can be connected rigidly and removably; means 39 for driving the spindle 38 in rotation; a setting-support holder 40, to which the support 1 can be connected rigidly and removably, and, if appropriate, means capable of ensuring a relative rotation of the tool 3 and of the setting-support holder 40 about the axis 41, so as to produce the subgroups of the second plurality.

The axis 41 of the setting-support holder 40 is at least substantially vertical or horizontal, and/or the axes 34, 41 of the tool 3 and of the setting-support holder 40 are at least substantially perpendicular to one another, and/or the support holder 40 is stationary.

An installation for the setting of stones 2 in supports 1 comprises at least one actual setting appliance and, furthermore, at least one shaping appliance 4.

The invention allows the light rays reaching the support 1 to be reflected, the effect being to give the impression of a stone 2 of greater size (or of greater brilliance). To achieve this, the inclinations given to the mirror facets 20 are of the same dimension, and finally their multiplicity, not forgetting their arrangement, location and surface state, are essential for ensuring the desired effect (for example, preventing undesirable shadows).

What is claimed is:

1. A metal setting support for an ornamental, precious stone having a diameter on the order of approximately one to a few millimeters, the stone having a longitudinal axis, a table perpendicular to the longitudinal axis, a crown, and a collet, the crown and the collet being cut to have a plurality of facets, at least some of the facets having substantially collinear edges, whereby the facets have a plurality of sets of substantially collinear edges, said setting support having a longitudinal axis and comprising:

an annular front transverse face lying in a general transverse plane P perpendicular to said setting support longitudinal axis, said annular front face having concentric circular inner and outer edges;

axial bore means extending through said front transverse face for coaxially receiving the stone, said bore means having a front end part forming a seat for axially receiving the collet of the stone;

a plurality of separate setting claw means extending from said annular front transverse face for assuming respective positions on the crown of the stone for ensuring the rigid retention of the stone in said setting support; and a plurality of mirror facet means formed in said annular front transverse face along respective chords of said outer edge of said annular front transverse face for increasing the apparent dimension and brilliance of the stone, each of said mirror facet means extending in a direction D and being inclined relative to said plane P, and each of said mirror facet means having first and second edges parallel to each other and to said direction D, to a chord of said outer edge of said annular front transverse face, and to one of said sets of substantially collinear edges of the facets of the stone;

wherein a pair of said claw means separated by a single intermediate one of said claw means defines a pair of reference claw means, wherein a chord of said outer edge of said annular front transverse face which extends between a pair of said reference claw means defines a boundary chord, wherein said plurality of mirror facet means is divided into a plurality of groups of mirror facet means, and wherein each of said groups extends substantially from a boundary chord to said outer edge of said annular front transverse face.

2. The setting support of claim 1, wherein at least one of said groups extends inwardly and outwardly of said respective intermediate claw means in relation to said setting support longitudinal axis, each of said facet means being offset relative to a diameter of said annular front transverse face.

3. The setting support of claim 1, wherein at least one of said groups extends inwardly of said respective intermediate claw means in relation to said setting support longitudinal axis, each of said facet means being offset relative to a diameter of said annular front transverse face.

4. The setting support of claim 1, wherein at least one of said groups extends outwardly of said respective intermediate claw means in relation to said setting support longitudinal axis, each of said facet means being offset relative to a diameter of said annular front transverse face.

5. The setting support of claim 1, wherein at least one of said groups is divided into first and second halves, said first and second halves extending respectively inwardly and outwardly of said respective intermediate claw means and forming between them a reserved strip, said respective intermediate claw means being located in said reserved strip.

6. The setting support of claim 1, wherein some of said mirror facet means extend parallel to and near a boundary chord and some of said mirror facet means extend parallel to a boundary chord adjacent a tangent to said outer edge.

7. A metal setting support for an ornamental, precious stone having a diameter on the order of approximately one to a few millimeters, the stone having a longitudinal axis, a table perpendicular to the longitudinal axis, a crown, and a collet, the crown and the collect being cut to have a plurality of facets, at least some of the facets having substantially collinear edges, whereby the facets have a plurality of sets of substantially collinear edges, said setting support having a longitudinal axis and comprising:

an annular front transverse face lying in a general transverse plane P perpendicular to said setting support longitudinal axis, said annular front face having concentric circular inner and outer edges;

axial bore means extending through said front transverse face for coaxially receiving the stone, said bore means having a front end part forming a seat for axially receiving the collect of the stone;

a plurality of separate setting claw means extending from said annular front transverse face for assuming respective positions on the crown of the stone for ensuring the rigid retention of the stone in said setting support; and a plurality of mirror facet means formed in said annular front transverse face along respective chords of said outer edge of said annular front transverse face for increasing the apparent dimension and brilliance of the stone, each of said mirror facet means extending in a direction D and being inclined relative to said plane P, and each of said mirror facet means having first and second edges parallel to each other and to said direction D, to a chord of said outer edge of said annular front transverse face, and to one of said sets of substantially collinear edges of the facets of the stone;

wherein a pair of said claw means separated by a single intermediate one of said claw means defines a pair of reference claw means, wherein a chord of said outer edge of said annular front transverse face which extends between a pair of said reference claw means defines a boundary chord, wherein said plurality of mirror facet means is divided into first and second pluralities of groups of mirror facet means, wherein each group of said first plurality of groups extends substantially from a boundary chord to said outer edge of said annular front transverse face, wherein said groups of said second plurality of groups are arranged angularly relative to one another with relation to said setting support longitudinal axis, and wherein there are the same number of groups in said second plurality of groups as the number of said claw means.

8. The setting support of claim 7, wherein said mirror facet means of said first and second pluralities of groups intersect.

9. A metal setting support for an ornamental, precious stone having a diameter on the order of approximately one to a few millimeters, the stone having a longitudinal axis, a table perpendicular to the longitudinal axis, a crown, and a collet, the crown and the collet being cut to have a plurality of facets, at least some of the facets having substantially collinear edges, whereby the facets have a plurality of sets of substantially collinear edges, said setting support having a longitudinal axis and comprising:

an annular front transverse face lying in a general transverse plane P perpendicular to said setting support longitudinal axis, said annular front face having concentric circular inner and outer edges;

axial bore means extending through said front transverse face for coaxially receiving the stone, said bore means having a front end part forming a seat for axially receiving the collect of the stone;

a plurality of separate setting claw means extending from said annular front transverse face for assuming respective positions on the crown of the stone for ensuring the rigid retention of the stone in said setting support; and a plurality of mirror facet means formed in said annular front transverse face along respective chords of said outer edge of said annular front transverse face for increasing the apparent dimension and brilliance of the stone, each of said mirror facet means extending in a direction D and being inclined relative to said plane P, and each of said mirror facet means having first and second edges parallel to each other and to said direction D, to a chord of said outer edge of said annular front transverse face, and to one of said sets of substantially collinear edges of the facets of the stone;

wherein each of said mirror facet means is associated with another mirror facet means together defining a pair of mirror facet means, wherein said mirror facet means of each said pair of mirror facet means have similar general characteristics and oppositely directed angles of inclination relative to said plane P and have substantially a V-shape in transverse cross-section perpendicular to said plane P, said mirror facet means of each said pair of mirror facet means forming an angle between them which reflects the light rays at all the angles at which the stone is viewed when being worn.

10. The setting support of claim 9, wherein said angle formed between said mirror facet means of each said pair of mirror facet means is between approximately 120° and 150°.

11. The setting support of claim 10, wherein said angle formed between said mirror facet means of each said pair of mirror facet means is between approximately 135° and 145°.

12. The setting support of claim 9, wherein planar strip means is formed between said mirror facet means of each said pair of mirror facet means for promoting the reflection of the light rays, wherein each said mirror facet means has a transverse width, and wherein said planar strip has a width no greater than approximately one-third the transverse width of one of said mirror facet means.

13. A bezel comprising:

an ornamental, precious stone having a diameter on the order of approximately one to a few millimeters, said stone having a longitudinal axis, a table perpendicular to the longitudinal axis, a crown, and a collet, the crown and the collet being cut to have a plurality of facets, at least some of said facets having substantially collinear edges, whereby the facets have a plurality of sets of substantially collinear edges; and a metal setting support for said stone, said setting support having a longitudinal axis and comprising:

(a) an annular front transverse face lying in a general transverse plane P perpendicular to said setting support longitudinal axis, said annular front face having concentric circular inner and outer edges;

(b) axial bore means extending through said front transverse face for coaxially receiving said stone, said bore means having a front end part forming a seat for axially receiving the collet of said stone;

(c) a plurality of separate setting claw means extending from said annular front transverse face for assuming respective positions on the crown of said stone for ensuring the rigid retention of said stone in said setting support; and (d) a plurality of mirror facet means formed in said annular front transverse face along respective chords of said outer edge of said annular front transverse face for increasing the apparent dimension and brilliance of the stone, each of said mirror facet means extending in a direction D and being inclined relative to said plane P, and each of said mirror facet means having first and second edges parallel to each other and to said direction D, to a chord of said outer edge of said annular front transverse face, and to one of said sets of substantially collinear edges of the facets of the stone;

wherein a pair of said claw means separated by a single intermediate one of said claw means defines a pair of reference claw means, wherein a chord of said outer edge of said annular front transverse face which extends between a pair of said reference claw means defines a boundary chord, wherein said plurality of mirror facet means is divided into a plurality of groups of mirror facet means, and wherein each of said groups extends substantially from a boundary chord to said outer edge of said annular front transverse face.

14. The bezel of claim 13, wherein at least one of said groups extends inwardly and outwardly of said respective intermediate claw means in relation to said setting support longitudinal axis, each of said facet means being offset relative to a diameter of said annular front transverse face.

15. The bezel of claim 13, wherein at least one of said groups extends inwardly of said respective intermediate claw means in relation to said setting support longitudinal axis, each of said facet means being offset relative to a diameter of said annular front transverse face.

16. The bezel of claim 13, wherein at least one of said groups extends outwardly of said respective intermediate claw means in relation to said setting support longitudinal axis, each of said facet means being offset relative to a diameter of said annular front transverse face.

17. The bezel of claim 13, wherein at least one of said groups is divided into first and second halves, said first and second halves extending respectively inwardly and outwardly of said respective intermediate claw means and forming between them a reserved strip, said respective intermediate claw means being located in said reserved strip.

18. The bezel of claim 13, wherein some of said mirror facet means extend parallel to and near a boundary chord and some of said mirror facet means extend parallel to a boundary chord adjacent a tangent to said outer edge.

19. A bezel comprising:

an ornamental, precious stone having a diameter on the order of approximately one to a few millimeters, said stone having a longitudinal axis, a table perpendicular to the longitudinal axis, a crown, and a collet, the crown and the collet being cut to have a plurality of facets, at least some of said facets having substantially collinear edges, whereby the facets have a plurality of sets of substantially collinear edges; and a metal setting support for said stone, said setting support having a longitudinal axis and comprising:

(a) an annular front transverse face lying in a general transverse plane P perpendicular to said setting support longitudinal axis, said annular front face having concentric circular inner and outer edges;

(b) axial bore means extending through said front transverse face for coaxially receiving said stone, said bore means having a front end part forming a seat for axially receiving the collet of said stone;

(c) a plurality of separate setting claw means extending from said annular front transverse face for assuming respective positions on the crown of said stone for ensuring the rigid retention of said stone in said setting support; and (d) a plurality of mirror facet means formed in said annular front transverse face along respective chords of said outer edge of said annular front transverse face for increasing the apparent dimension and brilliance of the stone, each of said mirror facet means extending in a direction D and being inclined relative to said plane P, and each of said mirror facet means having first and second edges parallel to each other and to said direction D, to a chord of said outer edge of said annular front transverse face, and to one of said sets of substantially collinear edges of the facets of the stone;

wherein a pair of said claw means separated by a single intermediate one of said claw means defines a pair of reference claw means, wherein a chord of said outer edge of said annular front transverse face which extends between a pair of said reference claw means defines a boundary chord, wherein said plurality of mirror facet means is divided into first and second pluralities of groups of mirror facet means, wherein each group of said first plurality of groups extends substantially from a boundary chord to said outer edge of said annular front transverse face, wherein said groups of said second plurality of groups are arranged angularly relative to one another with relation to said setting support longitudinal axis, and wherein there are the same number of groups in said second plurality of groups as the number of said claw means.

20. The bezel of claim 19, wherein said mirror facet means of said first and second pluralities of groups intersect.

21. The bezel of claim 19, wherein the number of said mirror facet means in each group of said second plurality of groups corresponds to the number of sides of said table of said stone, and wherein each said mirror facet means of each group of said second plurality of groups extends parallel to said corresponding side of said table.

22. A bezel comprising:

an ornamental, precious stone having a diameter on the order of approximately one to a few millimeters, said stone having a longitudinal axis, a table perpendicular to the longitudinal axis, a crown, and a collet, the crown and the collet being cut to have a plurality of facets, at least some of said facets having substantially collinear edges, whereby the facets have a plurality of sets of substantially collinear edges; and a metal setting support for said stone, said setting support having a longitudinal axis and comprising:

(a) an annular front transverse face lying in a general transverse plane P perpendicular to said setting support longitudinal axis, said annular front face having concentric circular inner and outer edges;

(b) axial bore means extending through said front transverse face for coaxially receiving said stone, said bore means having a front end part forming a seat for axially receiving the collet of said stone;

(c) a plurality of separate setting claw means extending from said annular front transverse face for assuming respective positions on the crown of said stone for ensuring the rigid retention of said stone in said setting support; and (d) a plurality of mirror facet means formed in said annular front transverse face along respective chords of said outer edge of said annular front transverse face for increasing the apparent dimension and brilliance of the stone, each of said mirror facet means extending in a direction D and being inclined relative to said plane P, and each of said mirror facet means having first and second edges parallel to each other and to said direction D, to chord of said outer edge of said annular front transverse face, and to one of said sets of substantially collinear edges of the facets of the stone wherein each of said mirror facet means is associated with another mirror facet means together defining a pair of mirror facet means, wherein said mirror facet means of each said pair of mirror facet means have similar general characteristics and oppositely directed angles of inclination relative to said plane P and have substantially a V-shape in transverse cross-section perpendicular to said plane P, said mirror facet means of each said pair of mirror facet means forming an angle between them which reflects the light rays at all the angles at which said stone is viewed when being worn.

23. The bezel of claim 22, wherein said angle formed between said mirror facet means of each said pair of mirror facet means is between approximately 120° and 150°.

24. The bezel of claim 23, wherein said angle formed between said mirror facet means of each said pair of mirror facet means is between approximately 135° and 145°.

25. The bezel of claim 22, wherein planar strip means is formed between said mirror facet means of each said pair of mirror facet means for promoting the reflection of the light rays, wherein each said mirror facet means has a transverse width, and wherein said planar strip has a width no greater than approximately one-third the transverse width of one of said mirror facet means.

* * * * *